US009243451B2

(12) United States Patent
Balczewski et al.

(10) Patent No.: US 9,243,451 B2
(45) Date of Patent: Jan. 26, 2016

(54) SYSTEM AND METHOD FOR PRE-CONDITIONING A HYDRATE RESERVOIR

(75) Inventors: John Thomas Balczewski, Danville, CA (US); Russell T. Ewy, San Ramon, CA (US)

(73) Assignee: CHEVRON U.S.A. INC., San Ramon, CA (US)

( * ) Notice: Subject to any disclaimer, the term of this patent is extended or adjusted under 35 U.S.C. 154(b) by 963 days.

(21) Appl. No.: 13/370,801

(22) Filed: Feb. 10, 2012

(65) Prior Publication Data

US 2013/0206414 A1 Aug. 15, 2013

(51) Int. Cl.

| | |
|---|---|
| ***E21B 43/00*** | (2006.01) |
| ***E21B 7/00*** | (2006.01) |
| *E21B 43/01* | (2006.01) |

(52) U.S. Cl.

CPC ..... *E21B 7/00* (2013.01); *E21B 2043/0115* (2013.01)

(58) Field of Classification Search

CPC E21B 2043/0115; E21B 43/24; E21B 33/138
USPC ..... 166/250.01
See application file for complete search history.

(56) References Cited

U.S. PATENT DOCUMENTS

| | | | | |
|---|---|---|---|---|
| 3,448,800 | A * | 6/1969 | Wahl et al. | 166/294 |
| 4,422,513 | A * | 12/1983 | Franklin | 175/17 |
| 6,978,837 | B2 * | 12/2005 | Yemington | 166/303 |
| 7,537,058 | B2 | 5/2009 | Gullapalli et al. | |
| 2003/0221832 | A1 * | 12/2003 | Reddy et al. | 166/300 |
| 2009/0236144 | A1 * | 9/2009 | Todd et al. | 175/5 |
| 2010/0147594 | A1 * | 6/2010 | Ben Lamin et al. | 175/340 |
| 2012/0097401 | A1 * | 4/2012 | Hester et al. | 166/369 |

OTHER PUBLICATIONS

"Fire in the Ice" vol. 10, Issue 2 pp. 9-11 "Relative Gas Volume Ratios for Free Gas and Gas Hydrate Accumulations" by Boswell et al.

* cited by examiner

*Primary Examiner* — William P Neuder
*Assistant Examiner* — Ronald Runyan

(57) ABSTRACT

A method of drilling into a geological region including a subsurface clathrate reservoir includes drilling a borehole into the geological region including the subsurface clathrate reservoir and dissociating at least a portion of the clathrate in a region near the borehole. After the dissociating, material within at least a portion of the region near the borehole in which the clathrate has been dissociated is compacted to form a compacted region at least partially surrounding the borehole within the clathrate reservoir. After the compacting, well casing is placed into the borehole within the compacted region and the well casing is cemented into the borehole in the compacted area.

20 Claims, 7 Drawing Sheets

Potential Volume Change in Dissociated Hydrates

| Example Hydrate Location | Potential Volume Change in Fluids (Gas + Water) |
|---|---|
| Mount Elbert C | 7.36 x |
| Mallik Zone A | 3.14 x |
| Nankai Site A-1 | 2.36 x |
| Nankai Site B-1 | 1.80 x |
| WR313 Orange Sand | 1.35 x |
| AC818 Frio Sand | 1.27 x |

Source: U.S. Department of Energy "Fire In The Ice" 2010
Vol. 10 Iss. 2 pp9-11 Boswell et al "Gas Volume Ratios"

FIG. 4

SYSTEM AND METHOD FOR PRE-CONDITIONING A HYDRATE RESERVOIR

FIELD

The present invention relates generally to exploitation of clathrate reservoirs and more particularly to improving recoverability of clathrate reservoirs.

BACKGROUND

Clathrates are substances in which a lattice structure made up of first molecular components (host molecules) that trap or encage one or more other molecular components (guest molecules) in what resembles a crystal-like structure. In the field of hydrocarbon exploration and development, clathrates of interest are generally clathrates in which hydrocarbon gases are the guest molecules in a water molecule host lattice. They can be found in relatively low temperature and high pressure environments, including, for example, deepwater sediments and permafrost areas. Clathrates are also referred to as hydrates, gas hydrates, methane hydrates, natural gas hydrates, CO2 hydrates and the like. For the purposes of this invention the term Clathrates will be used.

Clathrates generally form a significant portion of the structural support for the reservoir in which they occur, particularly with respect to cementing and/or occupying pore space. As clathrates dissociate, the constituents become mobile and cease acting as support, weakening the formation and potentially causing localized compaction of the reservoir. In a production environment, such localized subsurface compaction can lead to effects on equipment in the local area, both subsurface and on the surface. For example, in the subsurface environment, casings and drill strings may be collapsed due to high compressive loading caused by compaction of the reservoir, subsidence of the reservoir overburden strata and uplift of the reservoir underlying strata. On the surface, subsidence caused by subsurface clathrate dissociation and reservoir compaction can lead to sinkholes, subsidence, and other related motions that can cause damage to surface equipment such as well-heads, pipelines, equipment and other facilities in the immediate vicinity. The inventors have recognized a need to reduce or remediate this possibility.

SUMMARY

An aspect of an embodiment of the present invention includes a method of drilling into a geological region including a subsurface clathrate reservoir, including drilling a borehole into the geological region including the subsurface clathrate reservoir and dissociating at least a portion of the clathrate in a region near the borehole. After the dissociating, material within at least a portion of the reservoir region near the borehole in which the clathrate has been dissociated is compacted to form a compacted region at least partially surrounding the borehole within the clathrate reservoir. After the compacting, well casing is placed into the borehole within the compacted region and the well casing is cemented into the borehole in the compacted reservoir area.

An aspect of an embodiment may include a system for drilling into a geological region including a subsurface clathrate reservoir, including a drill, configured and arranged to drill a borehole into the geological region including the subsurface clathrate reservoir, a source of dissociation-promoting material configured and arranged to deliver the dissociation-promoting material to at least a portion of the clathrate in a region near the borehole, a device configured and arranged to place a well casing into the borehole after a dissociation and compacting process have been performed to form a compacted region of the reservoir at least partially surrounding the borehole within the clathrate reservoir, and a source of cement configured and arranged to cement production tubing in the borehole for use in producing hydrocarbons from the clathrate reservoir.

An aspect of an embodiment of the present invention includes a system including a drill bit or other mechanical device configured and arranged to direct drilling fluid in a radial direction relative to the borehole such that dissociation of surrounding clathrates is increased as a result of radial force from drilling fluid flow.

Aspects of embodiments of the present invention include computer readable media encoded with computer executable instructions for performing any of the foregoing methods and/or for controlling any of the foregoing systems.

DESCRIPTION OF THE DRAWINGS

Other features described herein will be more readily apparent to those skilled in the art when reading the following detailed description in connection with the accompanying drawings, wherein:

FIG. 4 presents data extracted from the U.S. National Energy Technology Laboratory methane hydrate newsletter "Fire in the Ice" Volume 10, Issue 2 pages 9-11 "Relative Gas Volume Ratios for Free Gas and Gas Hydrate Accumulations" by Boswell et al. illustrating a potential volume change in fluids (gas+water) immediately after dissociation occurs.

DETAILED DESCRIPTION

Figure 1A:
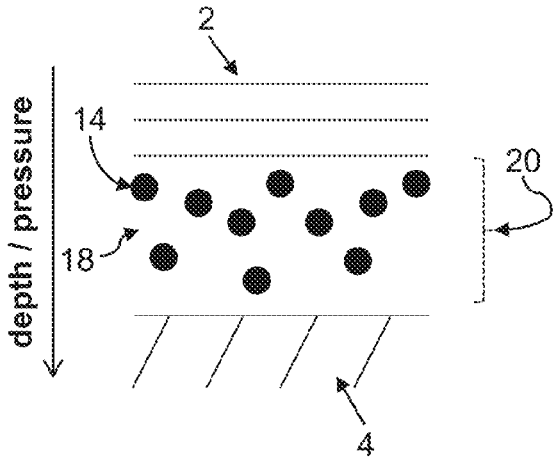
FIG. 1*a* illustrates a subsurface region where no clathrates are present having a deposit of unconsolidated sediment.
Figure 1B:
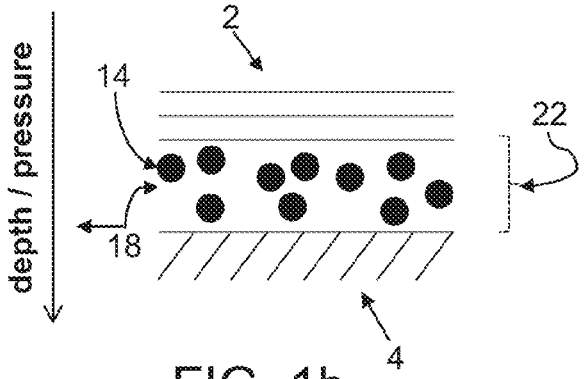
FIG. 1*b* illustrates a subsurface region where no clathrates are present having a deposit of consolidated sediment.
Figure 1C:
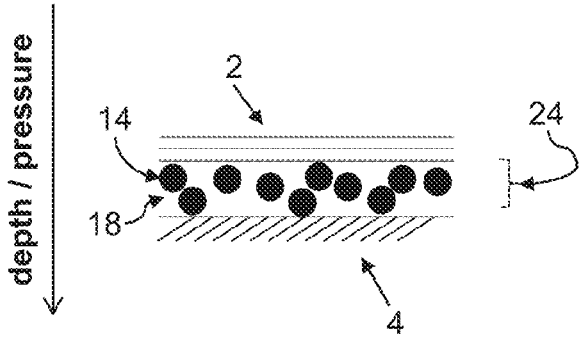
FIG. 1*c* illustrates a subsurface region where no clathrates are present having a deposit of fully compacted sediment.
Figure 1D:
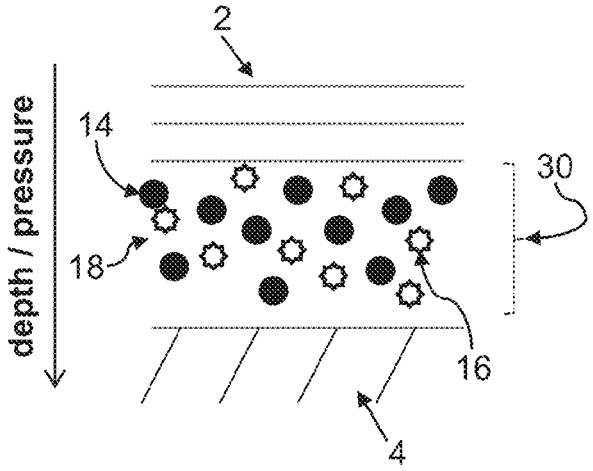
FIG. 1*d* illustrates a subsurface region where clathrates are present having a deposit of unconsolidated sediment and clathrates.
Figure 1E:
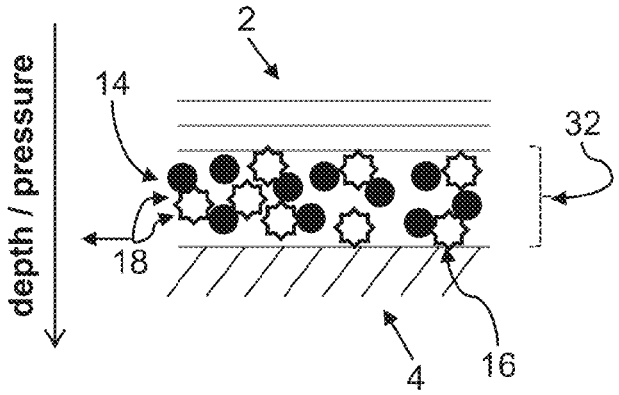
FIG. 1*e* illustrates a subsurface region where clathrates are present having a deposit of consolidated sediment and clathrates.
Figure 1F:
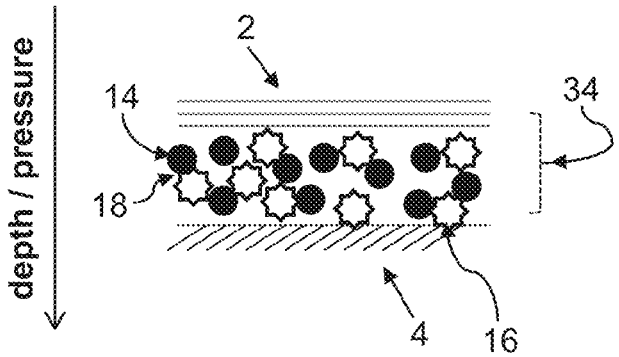
FIG. 1*f* illustrates a subsurface region where clathrates are present having a deposit of fully compacted sediment and clathrates.
Figure 1G:
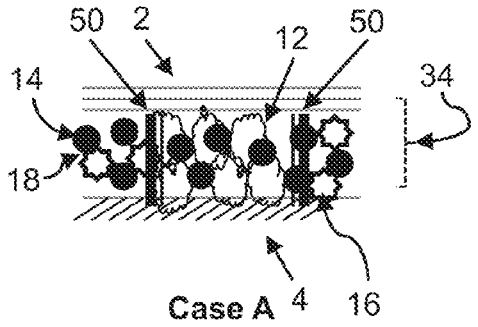
FIG. 1*g* illustrates a first consequence of localized clathrate dissociation in a subsurface region where clathrates are present.
Figure 1H:
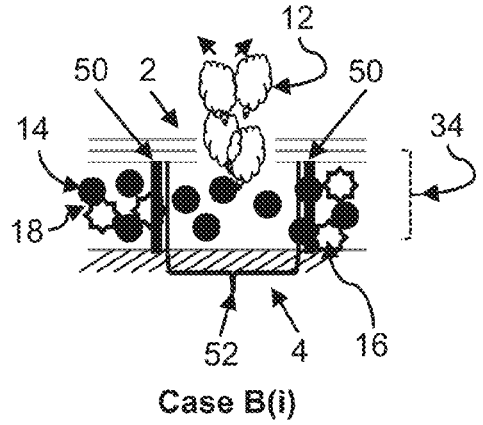
FIG. 1*h* illustrates a first part of a second consequence of localized clathrate dissociation in a subsurface region where clathrates are present.
Figure 1I:
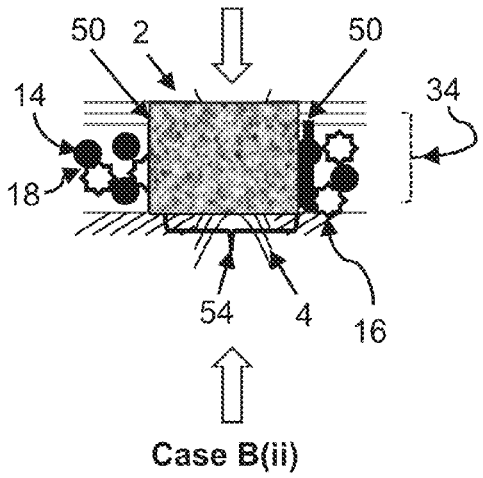
FIG. 1*i* illustrates a second part of a second consequence of localized clathrate dissociation in a subsurface region where clathrates are present.

FIGS. 1*a*-1*i* illustrate a subsurface region (which may represent a region below a land surface or the sea floor) in which hypothetical clathrate reservoirs might occur. FIGS. 1*a*-1*c* illustrate a structure where no clathrates are present. FIGS. 1*d*-1*f* illustrate a similar structure in which clathrates are also present. FIGS. 1*g*-1*i* illustrate a similar structure as depicted in FIGS. 1*d*-1*f* that at a point in time undergoes localized clathrate dissociation.

As shown in FIG. 1*a*, near the surface lies a deposit 20 of unconsolidated sediment containing solid sediment particles 14 and liquid water 18 in the pore spaces between the solid sediment particles 14. Deposit 20 lies between overburden 2 and underlying strata 4, as do all deposits in FIGS. 1*a*-1*i*. As the solid sediment particles 14 and liquid water 18 in deposit 20 become buried over geologic time, deposit 20 moves deeper below the surface and the solid sediment particles 14 and liquid water 18 within deposit 20 become exposed to increasing pressure with depth of burial. Under this increasing pressure the solid sediment particles 14 of deposit 20 remain relatively immobile while the liquid water 18 is able to flow out to lower pressure regions. This causes the solid sediment particles 14 to move closer together and at times come in contact with nearby solid sediment particles 14 (i.e., become more consolidated, or compacted), leaving less pore space between solid sediment particles 14 and likewise, relatively less liquid water 18 in the deposit. Eventually the burial process will convert the characteristics of deposit 20 into those of consolidated deposit 22 where most of the solid sediment particles 14 are in closer proximity or contact with each other, as illustrated in FIG. 1*b*. Proceeding deeper, the sediments become fully compacted with all solid sediment particles 14 in very tight contact with each other to form a deposit 24, as illustrated in FIG. 1*c*, still containing some water, but in very small pore spaces and comprising (for example) a rock-like sandstone deposit. Throughout this process the contacts between the solid sediment particles 14 bear more and more of the weight of all the sediment and water above them. As a very broad generalization with many exceptions there is a linear relationship between the compaction of a deposit and the depth of burial, with shallow deposits being relatively unconsolidated and deeper deposits becoming increasingly more compacted.

As shown in FIG. 1*d*, deposit 30 is nearly identical to deposit 20 in FIG. 1*a* with the exception that some of the liquid water 18 between the solid sediment particles 14 has come into contact with guest gas molecules at the appropriate temperature and pressure and together are converted into solid clathrate particles 16. The solid clathrate particles 16 generally mimic the behavior of their neighboring solid sediment particles 14. Deposit 30 therefore has solid sediment particles 14, solid clathrate particles 16 and liquid water 18 present in the space between particles. As the solid sediment particles 14, solid clathrate particles 16 and liquid water 18 in deposit 30 become buried over geologic time, deposit 30 moves deeper below the surface and the solid sediment particles 14, solid clathrate particles 16 and liquid water 18 within deposit 30 become exposed to increasing pressure with depth of burial. Under this increasing pressure the solid sediment particles 14 and solid clathrate particles 16 of deposit 30 remain relatively immobile while the liquid water 18 is able to flow out to lower pressure regions. Some liquid water 18 may also be reduced by continued conversion into solid clathrate particles 16. This causes the solid sediment particles 14 and solid clathrate particles 16 to move closer together and at times come in contact with nearby solid sediment particles 14 and /or solid clathrate particles 16 (i.e., become more consolidated, or compacted), leaving less pore space between solid sediment particles 14 and solid clathrate particles 16 and likewise, relatively less liquid water 18 in the deposit. As shown in FIG. 1*e*, deposit 32 may lose less thickness relative to deposit 22 in FIG. 1*b* due to this conversion of liquid water 18 in pore spaces into more and/or larger solid clathrate particles 16, preventing normal compaction. Eventually the burial process will convert the characteristics of deposit 30 illustrated in FIG. 1*d* into those of consolidated deposit 32 illustrated in FIG. 1*e* where most of the solid sediment particles 14 and solid clathrate particles 16 are in contact with each other. Proceeding deeper, as illustrated in FIG. 1*f*, the sediment and clathrates become fully compacted with all solid sediment particles 14 and solid clathrate particles 16 in very tight contact with each other to form a reservoir 34, still containing some water, but in very small pore spaces and forming (for example) a rock-like clathrate and sandstone reservoir. Throughout this process the contacts between the solid sediment particles 14 and solid clathrate particles 16 bear more and more of the weight of all the sediment and water above them. As a very broad generalization with many exceptions FIGS. 1*d*-1*f* illustrate a case where the presence of clathrates causes a form of compaction of a deposit that is different from that of FIGS. 1*a*-1*c*.

FIGS. 1*g*-1*i* contain cases illustrating two consequences to the reservoir 34 of FIG. 1*f* if the solid clathrate particles 16 undergo localized dissociation. Upon dissociation, the solid clathrate particles 16 change from incompressible and relatively immobile solids into very mobile fluids (generally, liquid water 18 and compressed free (guest) gasses 12 liberated from the clathrate lattice). This dissociation causes an instantaneous increase in local pressure as the compressed free gasses 12 attempt to expand to various multiples of their pre-dissociative space as detailed in FIG. 4. What was once a reservoir consolidated and under an in situ pressure roughly in proportion with its neighboring non-clathrate deposits suddenly contains either: Case A as shown in FIG. 1*g*-a localized high pressure pocket between the zones of dissociation 50 if there are no paths of relief; or Cases B (i) and (ii), shown in FIGS. 1*h* and 1*i*, respectively—where B(i) shows formation of a localized void 52 in the remaining undissociated reservoir 34 between the dissociation fronts 50 as dissociated liquid water 18 and compressed free gasses 12 move from the local high pressure area to lower pressure areas by whatever means that are available (permeability, faulting, flowing along or inside drill pipes, etc.). This immediately causes case B(ii) where the surrounding overburden 2 and underlying strata 4 displace into and fill the localized void 52 due to the pressure differential and form a compacted zone 54 in order to support the weight of all the deposits above them. The localized results of dissociation may be expected to hold in FIGS. 1*g*-1*i* or in any region in which clathrates form a part of the structural support of a formation. Note in particular that this newly compacted region does not contain any clathrates.

As will be appreciated, localized dissociation of a previously structurally stable sediment and clathrate subsurface reservoir will in many cases result in subsurface collapses. Such collapses can have both local (subsurface) effects and distant (surface) effects. FIGS. 2*a*-2*d* illustrate one potential subsurface result of dissociation-induced compaction during drilling and production operations.

Figure 2A:
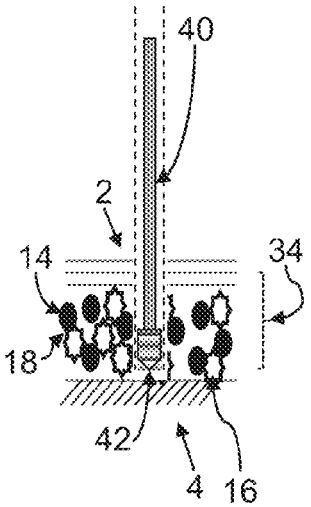
FIG. 2*a* illustrates a subsurface region where clathrates are present during drilling prior to clathrate dissociation.

FIG. 2*a* illustrates the situation prior to dissociation. A drill string 40 with drill bit 42 has been introduced into the clathrate reservoir 34 that is intended to be produced. The clathrate reservoir 34 includes solid sediment particles 14 along with solid clathrate particles 16 and minor amounts of liquid water 18. The clathrate reservoir 34 surrounding the drill string 40 and drill bit 42 is considered to be compacted equivalent to neighboring deposits at similar depths, and therefore relatively stable.

Figure 2B:
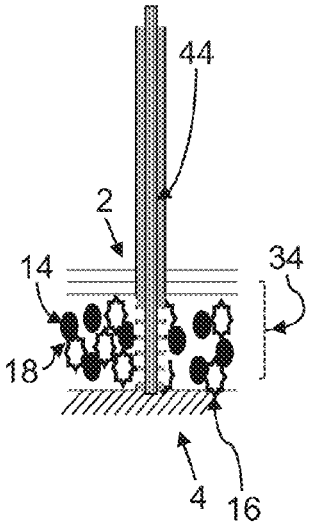
FIG. 2*b* illustrates a subsurface region where clathrates are present without preconditioning after drilling prior to clathrate dissociation.

FIG. 2*b* illustrates the situation after the drill string 40 and drill bit 42 are removed and production tubing and/or casing 44 is installed in one of the common manners.

Figure 2C:
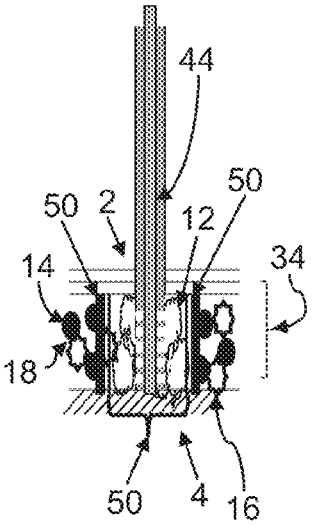
FIG. 2*c* illustrates a subsurface region where clathrates are present without preconditioning during production and clathrate dissociation.

As will be appreciated, efforts to produce the gasses stored in the clathrate and sediment reservoir 34 will entail intentionally inducing dissociation to free the gas from the clathrate host matrix. Such efforts may include, for example, decreasing pressure, adding heat, adding clathrate inhibiting materials and/or molecular substitution into the deposit 34 or any combination of these. See, for example, U.S. Pat. No. 7,537,058 describing production from a hydrate reservoir. As production begins, a zone of dissociation 50 shown in FIG. 2*c* is formed immediately in a highly localized radial zone around the production tubing and/or casing 44. This illustrates a key distinction between production of hydrocarbons from conventional hydrocarbon gas reservoirs and production of hydrocarbon gas clathrate reservoirs. Conventional hydrocarbon gas reservoirs are essentially large pressure vessels and as they are produced the reservoir pressure relatively uniformly drops and there is a relatively uniform compaction throughout the reservoir. Hydrocarbon gas clathrate reservoirs on the other hand produce hydrocarbon gas in essentially the opposite way: production commences by establishment of a dissociation front immediately at the wellbore and the dissociation front gradually moves out radially from the wellbore, as does compaction.

Figure 2D:
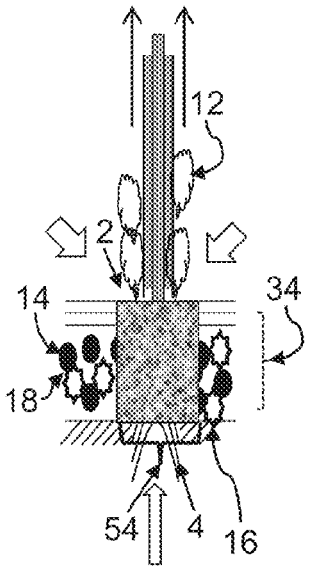
FIG. 2*d* illustrates dissociation-induced compaction in a subsurface region where clathrates are present without preconditioning.

As the clathrates 16 are dissociated into liquid water 18 and compressed free gas 12, the remaining reservoir sediment becomes progressively less consolidated as illustrated by FIG. 2*c*. At some point, the structural support of the dissociated area is exceeded by the hydrostatic and lithostatic pressure and the overburden 2 and underlying strata 4 surrounding production tubing and/or casing 44 may displace into the resultant void and create a compacted zone 54, crushing the production string as illustrated in FIG. 2*d*. Generally, the production tubing and/or casing and surrounding sealing cement will collapse radially and/or axially. Other failure modes may include flow of gas up the exterior of the collapsed drill string and cement, potentially blowing out to the surface or sea floor.

Figure 3A:
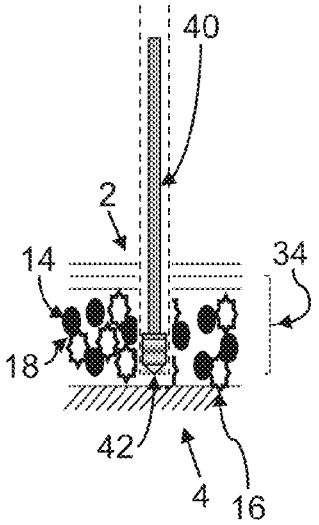
FIG. 3*a* illustrates a subsurface region where clathrates are present during drilling prior to pre-conditioning.
Figure 3B:
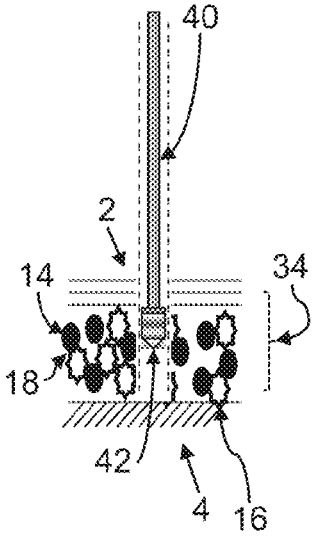
FIG. 3*b* illustrates a subsurface region where clathrates are present after drilling prior to pre-conditioning.
Figure 3C:
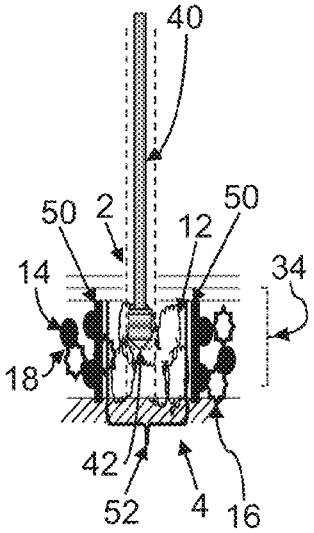
FIG. 3*c* illustrates a subsurface region where clathrates are present after drilling and during promotion of clathrate dissociation.
Figure 3D:
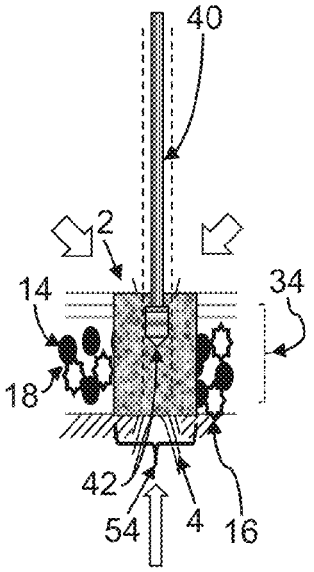
FIG. 3*d* illustrates pre-conditioning a subsurface region where clathrates are present.
Figure 3E:
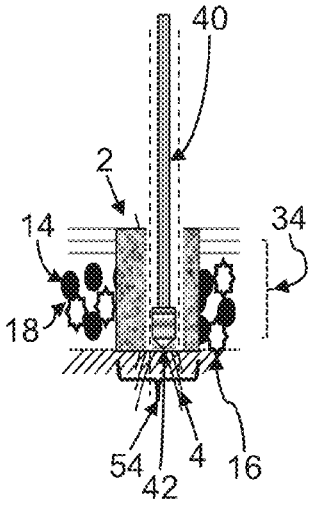
FIG. 3*e* illustrates a subsurface region where clathrates are present during re-drilling after pre-conditioning.
Figure 3F:
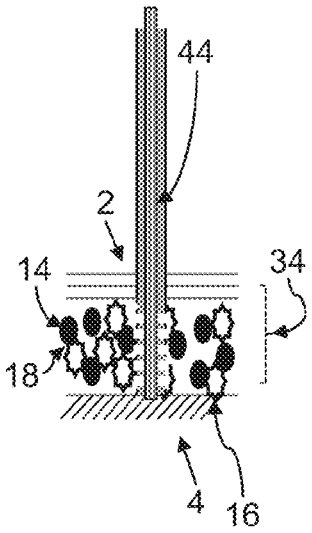
FIG. 3*f* illustrates a completed well in a subsurface region where clathrates are present after pre-conditioning and re-drilling.

In order to reduce or eliminate this effect, steps may be taken to pre-condition (pre-compact) the reservoir in way of the selected production well location after the initial drilling and prior to installation of the production string such that catastrophic collapse during initial production can be avoided as illustrated in FIGS. 3*a*-3*g*. As illustrated in FIG. 3*a*, the reservoir is drilled. Then the drill pipe 40 and drill bit 42 are repositioned somewhere between the total well depth and a point near or above the top of the clathrate reservoir (FIG. 3*b*) and one and/or more methods that promote dissociation are applied to the reservoir (FIG. 3*c*) to create a void 52.

In one example of promoting dissociation, hot water, hot drilling mud or other heated fluid may be injected or circulated, raising the temperature of the clathrates, causing dissociation. Alternately, or in addition, clathrate inhibiting chemicals may be injected. Such inhibiting chemicals include, for example, salts, methanol and glycols including but not limited to monoethylene glycol and diethylene glycol.

In another approach, mobile fluids present in the reservoir, water for example, may be pumped out to reduce the reservoir's pressure to a point below the pressure of clathrate stability, causing dissociation. One method of achieving this is to use underbalanced drilling techniques. Another example could be deployment of a submersible pump located at the end of the drill string.

In one embodiment, the dissociation process may be begun during the initial drilling operation by adding heat and/or inhibiting chemicals to the drilling fluid circulating through the zone of interest and/or utilizing underbalanced drilling techniques.

As will be appreciated, dissociation induced by any of the foregoing methods will tend to proceed outwardly in a radial direction from the outer edges of the original borehole. By way of example, dissociation may be induced in a radius of a few meters around the borehole, for example, between about 1 m and about 10 m. In a particular embodiment, the treated region is lm surrounding the borehole. In an embodiment, dissociation is induced along a complete vertical extent of the reservoir.

Withdrawing the drill pipe to the top of the clathrate reservoir prior to inducing dissociation maintains the drill pipe in a state of tension during localized slumping downward of the overburden in the drilling pipe's vicinity, a situation for which it is well-engineered.

In application, it may be useful to limit the progress of the dissociation to control the volumes of gas and/or water generated with limitations of the drilling system in mind. Embodiments of these methods may include reducing the applied heat and/or inhibiting chemicals and/or increasing the bottom whole pressure such that the rate of dissociation is reduced or stopped as appropriate.

Gas released in the dissociation process will generally escape through the borehole along with the circulating fluids. The gas may be collected, combined with other hydrocarbon production, or alternately it may be flared and/or otherwise vented.

Likewise, fluid (e.g., water) released by dissociation may be collected. This collection serves both to remove water from the area to be compacted, preventing it from re-forming clathrates and to further decrease relative pressures in the zone, improving the dissociation rate and increasing compaction. The collected fluid may be treated and may then be disposed of or used for other purposes. For example, it may be re-injected into other subterranean formations, either for disposal or for use in flooding for sustained conventional oil production in a later stage recovery process.

Once the clathrate is dissociated in a region surrounding the borehole, the empty borehole will generally collapse. In one approach, prior to collapse or induction of dissociation, additional stabilizing material may be injected into the borehole. For example, gravel, sand or similar filler materials may be injected into the bottom of the borehole or into a region surrounding the borehole prior to dissociation and collapse, either to reduce the displacement of overlaying or underlying strata and/or to create and/or maintain a zone of high permeability in the wellbore area. In either case, the collapsed region has become consolidated to form the compacted region 54 (FIG. 3*d*), which region no longer contains hydrates.

Figure 3G:
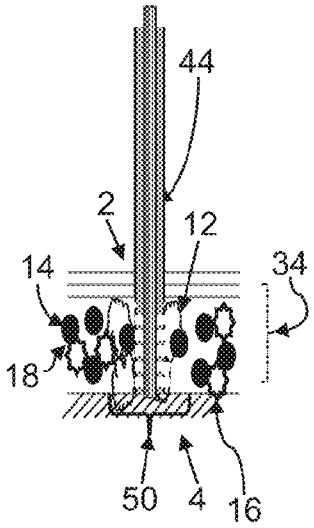
FIG. 3*g* illustrates production in a subsurface region where clathrates are present after pre-conditioning and well completion.

After the consolidation steps are completed, and the clathrate reservoir area below the drill string is appropriately consolidated, the well may be re-drilled through the now-consolidated area (FIG. 3*e*), completed (FIG. 3*f*) and produced (FIG. 3*g*). Likewise, surface facilities, pipelines and other massive equipment may be safely sited directly above the compacted area.

In the case of large reservoirs, it may be useful to make use of multiple boreholes for production, injection and/or monitoring. In these cases, it should be appreciated that pre-compaction methods in accordance with embodiments of the present invention may be applied to one or more of the boreholes, and that in a particular embodiment, each borehole.

As will be appreciated, the method as described herein may be performed using a computing system having machine executable instructions stored on a tangible medium. The instructions are executable to perform each portion of the method, either autonomously, or with the assistance of input from an operator. In an embodiment, the system includes structures for allowing input and output of data, and a display that is configured and arranged to display the intermediate and/or final products of the process steps. A method in accordance with an embodiment may include an automated selection of a location for exploitation and/or exploratory drilling for hydrocarbon resources.

Those skilled in the art will appreciate that the disclosed embodiments described herein are by way of example only, and that numerous variations will exist. The invention is limited only by the claims, which encompass the embodiments described herein as well as variants apparent to those skilled in the art. In addition, it should be appreciated that structural features or method steps shown or described in any one embodiment herein can be used in other embodiments as well.

The invention claimed is:

1. A method of drilling into a geological region including a subsurface clathrate reservoir, comprising:

drilling a borehole into the geological region including the subsurface clathrate reservoir;

dissociating at least a portion of clathrates in a region near the borehole;

measuring an amount of gas, fluids, or both generated during the dissociating to provide a measured amount, comparing the measured amount to a baseline, and using the measured amount as an indicator of compaction completion;

after the dissociating, compacting material within at least a portion of the region near the borehole in which the clathrates have been dissociated to form a compacted region at least partially surrounding the borehole within the subsurface clathrate reservoir;

after the dissociating and compacting, placing a well casing into the borehole within the compacted region; and cementing the well casing into the borehole in the compacted region.

2. A method as in claim 1, wherein the dissociating comprises heating the portion of the clathrates.

3. A method as in claim 2, wherein the heating comprises heating a drilling fluid used in the drilling.

4. A method as in claim 1, wherein the dissociating comprises reducing a pressure to which the portion of the clathrates are subject.

5. A method as in claim 4, wherein the drilling comprises underbalanced drilling such that the pressure to which the portion of the clathrates are subject is reduced.

6. A method as in claim 1, wherein the dissociating comprises adding a material that inhibits formation of clathrates.

7. A method as in claim 1, wherein the dissociating comprises adding a material that inhibits formation of clathrates to drilling fluid used in the drilling.

8. A method as in claim 1, wherein the compacting further comprises injecting cement into the portion of the region near the borehole in which the clathrates have been dissociated.

9. A method as in claim 1, further comprising, before the cementing, and after the placing, injecting material into a region between the compacted region and the casing.

10. A method as in claim 1, further comprising, during the dissociating, collecting hydrocarbon gases produced by the dissociating.

11. A method as in claim 10, wherein the collected hydrocarbon gases are vented, flared, or both.

12. A method as in claim 1, further comprising, during the dissociating, collecting water produced during the dissociating.

13. A method as in claim 12, wherein the collected water is disposed of, re-injected into other subterranean formations, or re-injected into other subterranean formations for the purpose of enhancing hydrocarbon production.

14. A method as in claim 1, wherein the portion of the region near the borehole in which the clathrates have been dissociated comprises a radial region surrounding the borehole and extending vertically throughout a vertical extent of the subsurface clathrate reservoir along the borehole.

15. A system for drilling into a geological region including a subsurface clathrate reservoir, comprising:

a drill configured and arranged to drill a borehole into the geological region including the subsurface clathrate reservoir;

a source of dissociation-promoting material configured and arranged to deliver the dissociation-promoting material to at least a portion of clathrates in a region near the borehole, wherein a measurement is made of an amount of gas, fluids, or both generated during the dissociating, the measured amount is compared to a baseline, and the measured amount is used as an indicator of compaction completion;

a device configured and arranged to place a well casing into the borehole after a dissociation and compacting process have been performed to form a compacted region at least partially surrounding the borehole within the subsurface clathrate reservoir; and a source of cement configured and arranged to cement production tubing in the borehole for use in producing hydrocarbons from the subsurface clathrate reservoir.

16. A system to perform a method comprising:

drilling a borehole into a geological region including a subsurface clathrate reservoir;

dissociating at least a portion of clathrates in a region near the borehole;

measuring an amount of gas, fluids, or both generated during the dissociating to provide a measured amount, comparing the measured amount to a baseline, and using the measured amount as an indicator of compaction completion;

after the dissociating, compacting material within at least a portion of the region near the borehole in which the clathrates have been dissociated to form a compacted region at least partially surrounding the borehole within the subsurface clathrate reservoir;

after the dissociating and compacting, placing a well casing into the borehole within the compacted region; and cementing the well casing into the borehole in the compacted region.

17. A system as in claim 15, wherein the dissociation comprises heating the portion of the clathrates.

18. A system as in claim 15, wherein the dissociation comprises reducing a pressure to which the portion of the clathrates are subject.

19. A system as in claim 15, wherein the dissociation comprises adding a material that inhibits formation of clathrates.

20. A method as in claim 1, wherein the compacting further comprises injecting cement into the portion of the region near the borehole in which the clathrates have been dissociated.

* * * * *